US007578226B2

(12) United States Patent
Moucheboeuf et al.

(10) Patent No.: US 7,578,226 B2
(45) Date of Patent: Aug. 25, 2009

(54) DEVICE TO SEPARATE THE LINKS OF AN AMMUNITION BELT

(75) Inventors: Gérard Moucheboeuf, Bourges (FR); Gérard Gerbault, Saint Doulchard (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 12/004,026

(22) Filed: Dec. 20, 2007

(65) Prior Publication Data

US 2008/0245219 A1 Oct. 9, 2008

(30) Foreign Application Priority Data

Jan. 10, 2007 (FR) ..... 07 00150

(51) Int. Cl.
*F42B 39/08* (2006.01)
*F41A 9/58* (2006.01)

(52) U.S. Cl. ..... 89/35.02; 89/34

(58) Field of Classification Search ..... 89/33.01, 89/33.1, 33.14, 33.16, 33.17, 33.2, 33.25, 89/33.4, 34, 35.01, 35.02
See application file for complete search history.

(56) References Cited

U.S. PATENT DOCUMENTS 2,345,340 A 3/1944 Howe
2,418,428 A * 4/1947 Rundquist ..... 89/33.2
2,467,571 A 4/1949 Webb
2,519,947 A * 8/1950 Watt ..... 89/33.14
2,979,992 A * 4/1961 Colby ..... 89/33.2
3,333,506 A * 8/1967 Henshaw et al. ..... 89/33.25
3,367,236 A * 2/1968 Menneking ..... 89/33.25
4,004,492 A * 1/1977 Savioli ..... 89/35.02
4,270,437 A * 6/1981 Donovan ..... 89/192
4,658,701 A * 4/1987 Moore ..... 89/33.2
5,111,732 A * 5/1992 Marcon et al. ..... 89/135
5,684,265 A * 11/1997 Strasser et al. ..... 89/33.14

FOREIGN PATENT DOCUMENTS

FR 2 849 498 A1 7/2004

* cited by examiner

*Primary Examiner*—Bret Hayes
(74) *Attorney, Agent, or Firm*—Oliff & Berridge, PLC

(57) ABSTRACT

A device to separate the links (M1, M2) of an ammunition belt, such belt exiting a weapon after firing and in which the links are mounted so as to pivot angularly with respect to one another, a relative pivoting position of a first link (M1) with respect to the following link (M2) enabling the first link to be unhooked, the device incorporating at least one tab integral with a support of the weapon and placed in proximity to the exit of the belt from the support, and able to make each link pivot with respect to the following one, wherein the at least one tab is placed above an exit of the belt, the at least one tab being pushed by the exiting of a first link (M1) against the action of a spring and which cooperates with a rear edge of the body of the first link (M1) to make it pivot with respect to the following link (M2), thus unhooking it. In alternative embodiments, the at least one tab is an elastic tab adapted to be deformed by the exiting first link.

5 Claims, 7 Drawing Sheets

DEVICE TO SEPARATE THE LINKS OF AN AMMUNITION BELT

BACKGROUND OF THE INVENTION

1. Field of Invention

The technical scope of the invention is that of devices to feed a weapon with ammunition and in particular that of devices enabling the links to be separated from one another upon exiting the weapon after the ammunition has been fired.

2. Description of the Related Art

Ammunition fired from medium caliber (caliber of between 20 mm and 50 mm) weapons is generally assembled on link chains or belts. These belts facilitate the introduction of the ammunition into the weapon. The ammunition is stored in a magazine with its belt. The belt enables the ammunition to be fed into the weapon by using feed channels. The feed system of the weapon thus brings the ammunition one after another up to the gun chamber where the correctly positioned ammunition is extracted from its belt ready to be fired.

The belt then exits the weapon free of its ammunition.

In certain weapon systems, namely turret-mounted systems for which there is a problem of available space inside the turret, the link belts have to be evacuated outside the turret or else stored inside the turret in as little space as possible.

However, these link belts, still connected to each other, accumulate to form blocks integral with the turret which can hinder the latter's use.

Devices are thus being researched in order to ensure the separation of the different links forming the belt upon exiting the weapon or the turret.

Naturally, the solution for a device to separate such links will be specific to the architecture of the link belt.

The invention more particularly relates to a device intended to separate the links of a chain in which the links are mounted able to pivot angularly with respect to one another, a relative pivoting of a first link with respect to the following link enabling the first link to be unhooked.

Such a link belt structure is well known to someone skilled in the art.

FIG. 1*a* thus shows two links M1, M2 of such a belt separated from one another whereas FIG. 1*b* shows these links assembled.

We can see that each link incorporates a central stirrup 1 and two lateral stirrups 2. Each stirrup is partially cylindrical in shape so as to receive a piece of ammunition. The central stirrup 1 of link M2 incorporates circular ribs 3 which cooperate with circular grooves 4 in the lateral stirrups 2 of link M1.

Thus, as can be seen in FIG. 1*b* when links M1 and M2 are assembled, the central stirrup of one link is positioned between the lateral stirrups of the other and a relative pivoting of M1 with respect to M2 is possible via the cooperation of the ribs 3 with the grooves 4.

Belts of links are thus formed which are flexible enough to bring the ammunition into the channels in the weapon.

When the ammunition is set into position on the belt, it forms an obstacle and it is no longer possible for the links to be made to pivot with sufficient amplitude to enable the belt to be disassembled.

However, when the ammunition has been extracted, it is possible to make a link pivot with respect to the one following to enable the disassembly of the belt.

Patent FR-2849498 proposes a device to separate the links in which an elastic tab is positioned below the exit of the belt from the turret. The purpose of this tab, by guiding the exiting link upwards, is to make it pivot with respect to the following link thereby enabling the links to be separated from one another.

This device suffers from drawbacks, however.

Indeed, we can notice that when a link does not pivot sufficiently (for example because the connection between the links causes too much friction), it is not released by the passage of the tab and remains locked to the following link. The following link is thus no longer able to be swiveled since its pivoting capacity is reduced. This results in the exiting of belts whose links are not dissociated, such belts being directed to the top of the turret and accumulating on it.

The device is therefore insufficiently reliable. Furthermore, the greater or lesser flexibility of the connection between the tab and the turret is also likely to disturb delinking.

SUMMARY OF THE INVENTION

The aim of the invention is to propose a device of simple design which is more reliable than the known device.

The device according to the invention is thus certain to ensure the separation of the different links of the belt upon its exiting the turret. The device proposed requires no adjustments and its reliability is not reduced over time.

Thus, the invention relates to a device to separate the links of an ammunition belt, such belt exiting a weapon after firing and in which the links are mounted so as to pivot angularly with respect to one another, a relative pivoting position of a first link with respect to the following link enabling said first link to be unhooked, device incorporating elastic means integral with a support of the weapon and placed in proximity to the exit of the belt from this support, and able to make each link pivot with respect to the following one, device wherein the elastic means comprise at least one tab placed above an exit of the belt, such tab being pushed by the exiting of a first link against the action of spring means and which cooperates with a rear edge of the body of the first link to make it pivot with respect to the following link thus unhooking it.

The separation device advantageously comprises a support band arranged below the belt exit, such band supporting the link during the displacement of the tab or tabs and as the link is pivoting.

According to a first embodiment, each tab may be an elastic tab deformed by the passage of the links, each tab thus forming in itself the spring means making the link body pivot.

According to a second embodiment, each tab may be a rigid tab integral with a torsion spring which will constitute the spring means able to make the link body pivot.

The separation device may incorporate two tabs and these may be positioned on either side of the support band.

BRIEF DESCRIPTION OF THE DRAWINGS

The invention will become more apparent from the following description made with reference to the appended drawings, in which.

DETAILED DESCRIPTION OF THE PREFERRED EMBODIMENTS

Figure 1A:
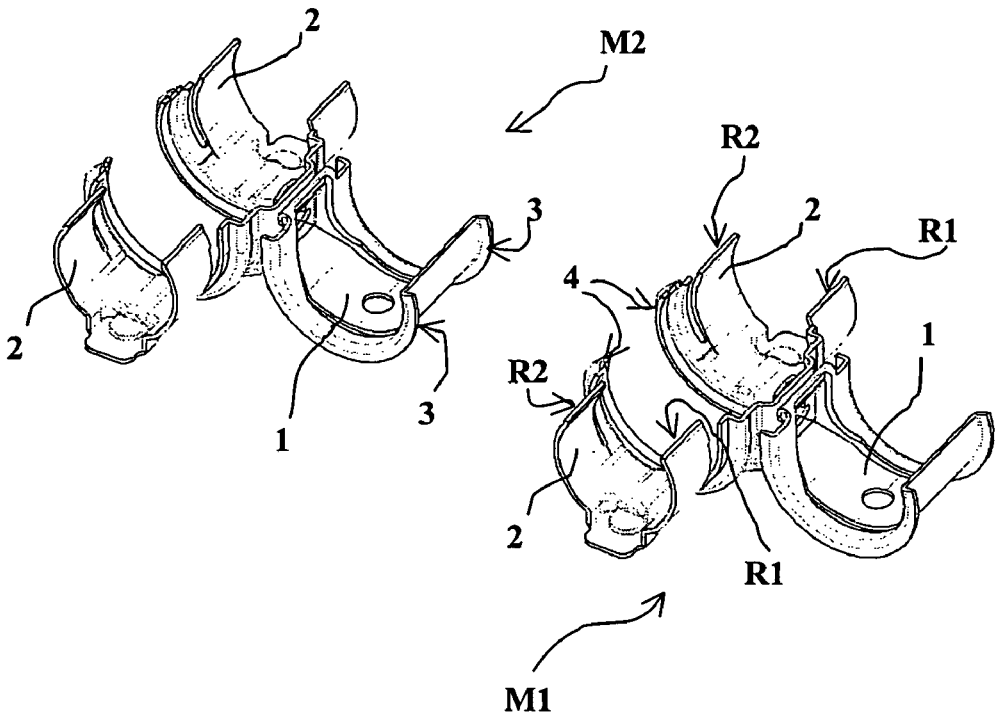
FIGS. 1*a* and 1*b* give a perspective view of the links of an ammunition belt, which the invention proposes to separate automatically.
Figure 1B:
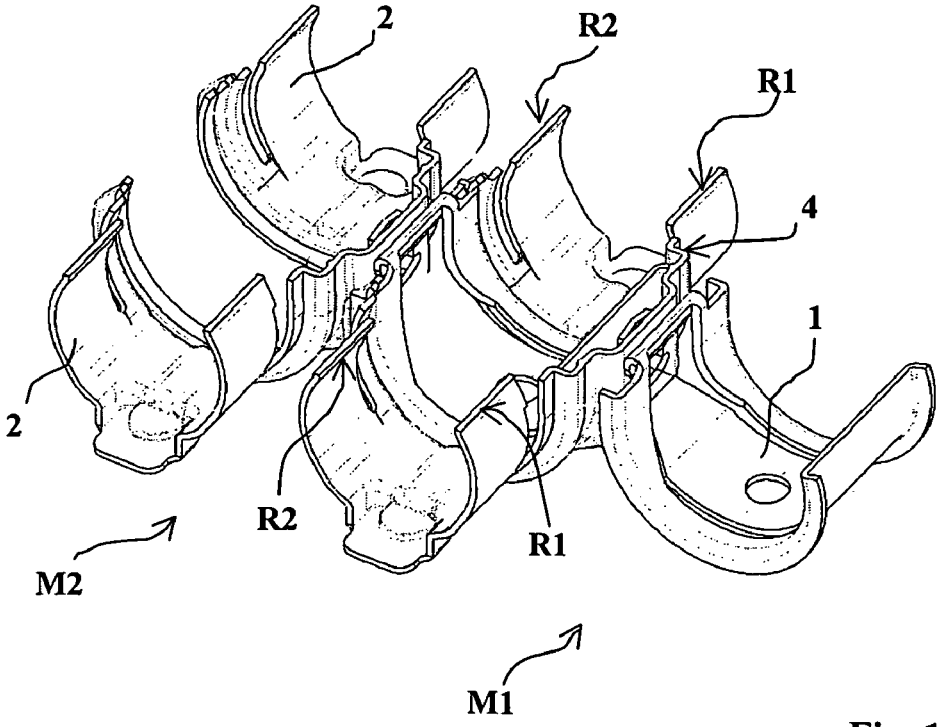

FIGS. 1*a* and 1*b* have been described in the preamble to the present application. Their only purpose is to specify the structure of links M1 and M2 constituting an ammunition belt which the invention proposes to separate.

Figure 2A:
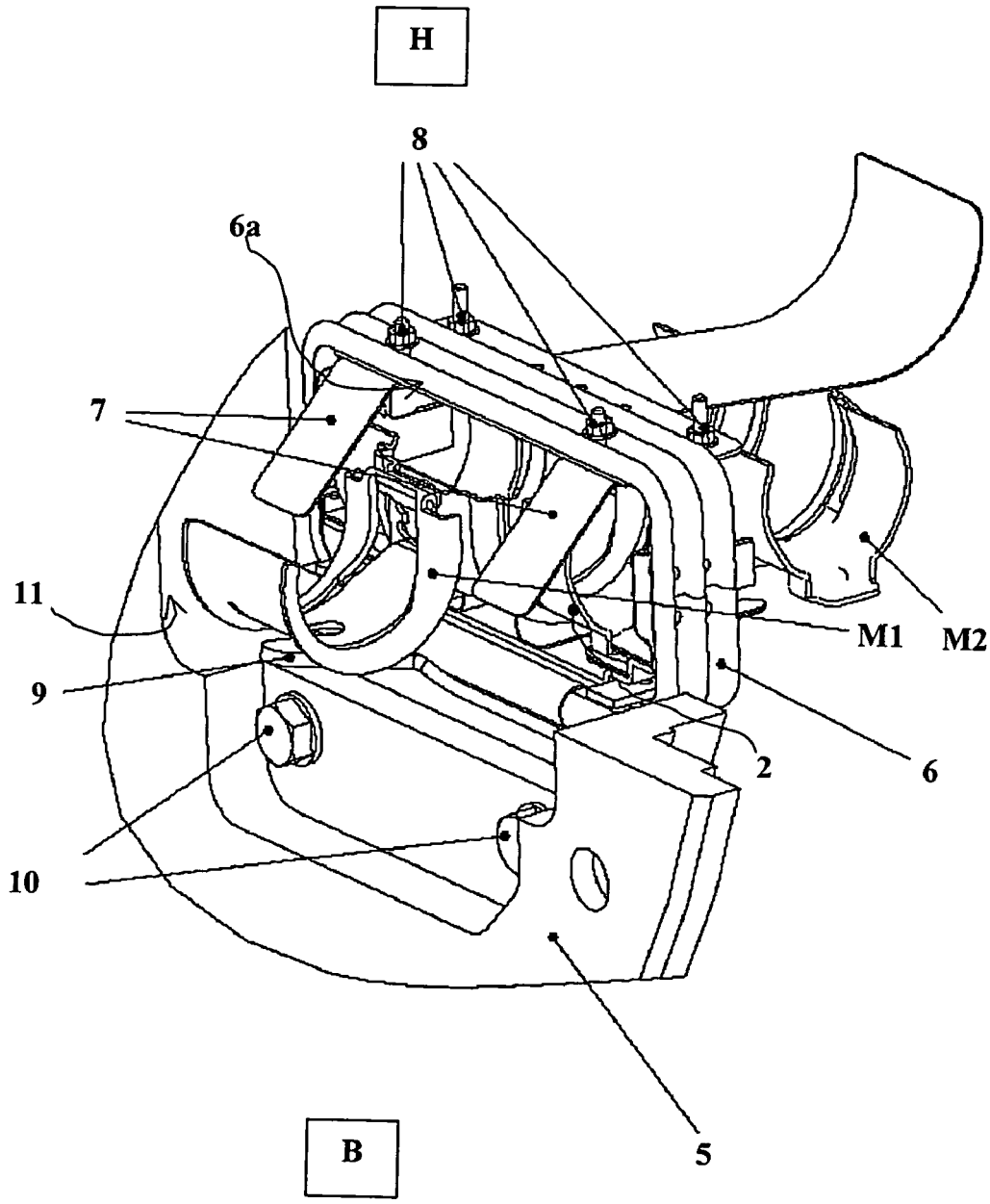
FIGS. 2*a* and 2*b* are two perspective views showing the belts exiting from the turret according to a first embodiment of the invention.
Figure 2B:
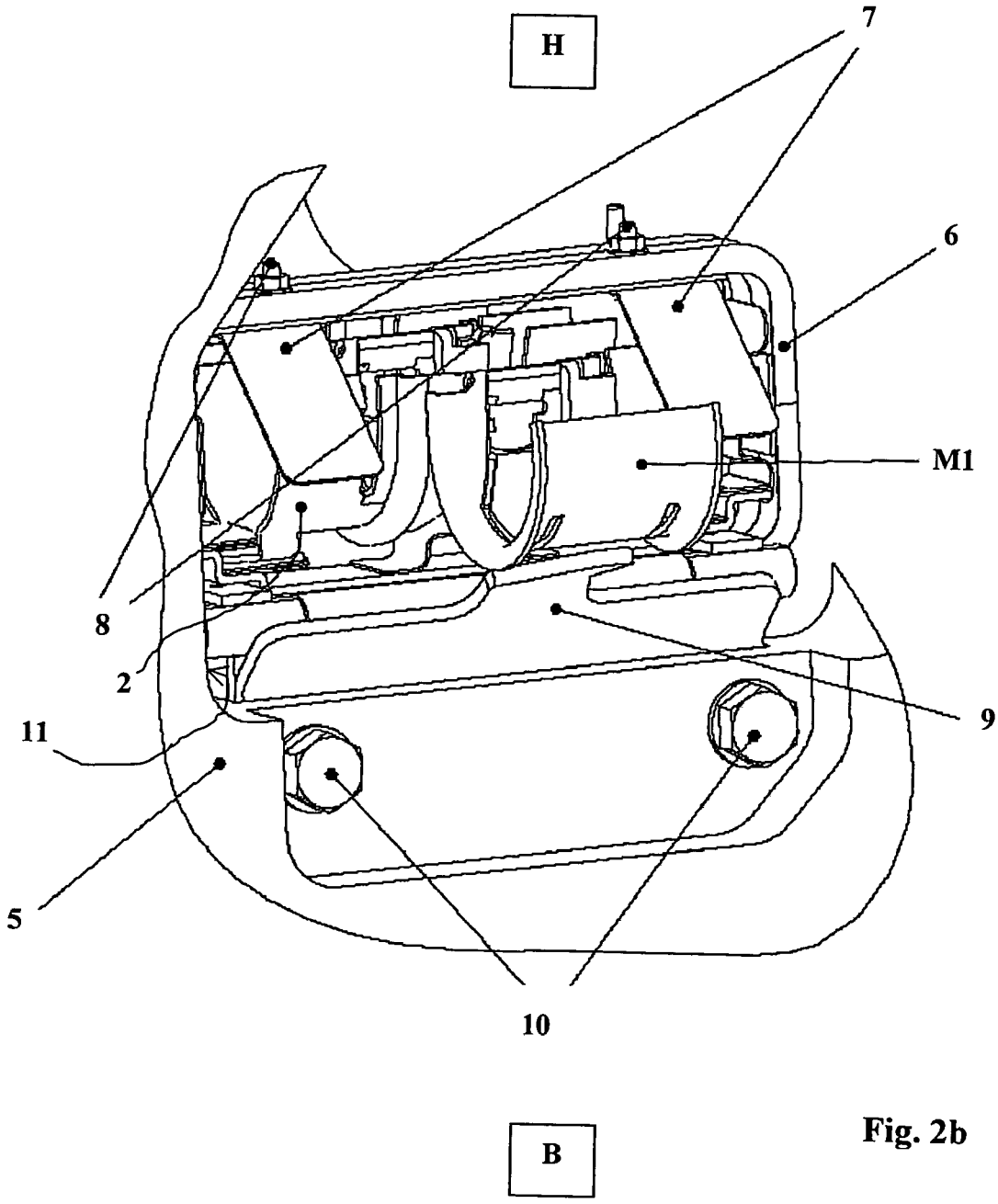

FIGS. 2*a* and 2*b* show a separation device for links M1 and M2 of a belt. A support 5 integral with the weapon (not shown) or turret has been represented on these Figures. An opening 11 is arranged in this support to enable the belt to exit.

The invention incorporates elastic means 7 made integral with the support 5 by means of a frame 6 positioned opposite the opening 11 and fixed to the support 5 by means not shown.

Elastic means 7 are fixed to the frame 6, for example by screws.

According to this embodiment, the elastic means are constituted by two elastic tabs which extend outwards from an upper edge 6*a* of the frame 6. The tabs 7 are made, for example, of spring steel.

The elastic tabs 7 are, moreover, oriented downwards B so as to be deformed by the passage of the links M forming the belt.

The device according to the invention also comprises a support band 9 positioned below the opening 11. This band 9 is substantially horizontal (or is slightly tilted upwards H, for example by less than 5°, such tilting enabling the pivoting of the link to be initiated) and provides a support for the central stirrup 1 of the link M1. The band thereby provides a support for link M1 during the deformation of the elastic tab or tabs 7 further to the exiting of the belt.

The two elastic tabs 7 are positioned along vertical parallel planes and are arranged on either side of a vertical plane passing by the support band 9. Thus, each tab 7 will come to press on a lateral stirrup 2 of a given link whereas, at the same time, the band 9 will ensure the support of the central stirrup 1 of the link in question.

The operation of the device according to the invention will now be described with reference to FIGS. 3*a* to 3*f*.

Figure 3A:
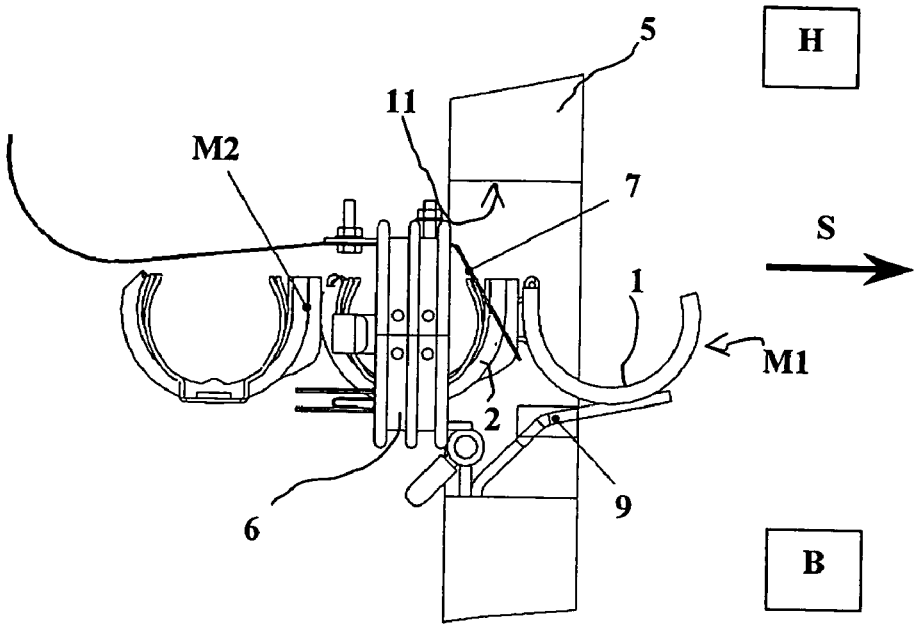
FIGS. 3*a*, 3*b*, 3*c*, 3*d*, 3*e* and 3*f* show different successive phases of the operation of the device according to the invention.

FIG. 3*a* shows the device when the first link M1 of the belt reaches the opening 11. The arrow S indicates the exiting direction of the link belt from the support 5 and through the opening 11. Reference marks H and B respectively represent the top H and bottom B of the device with respect to the vertical.

The central stirrup 1 of the first link M1 can be seen to press on the support band 9. The elastic tabs 7 are in contact with the lateral stirrups 2 of the first link M1 and have not yet been deformed.

Figure 3B:
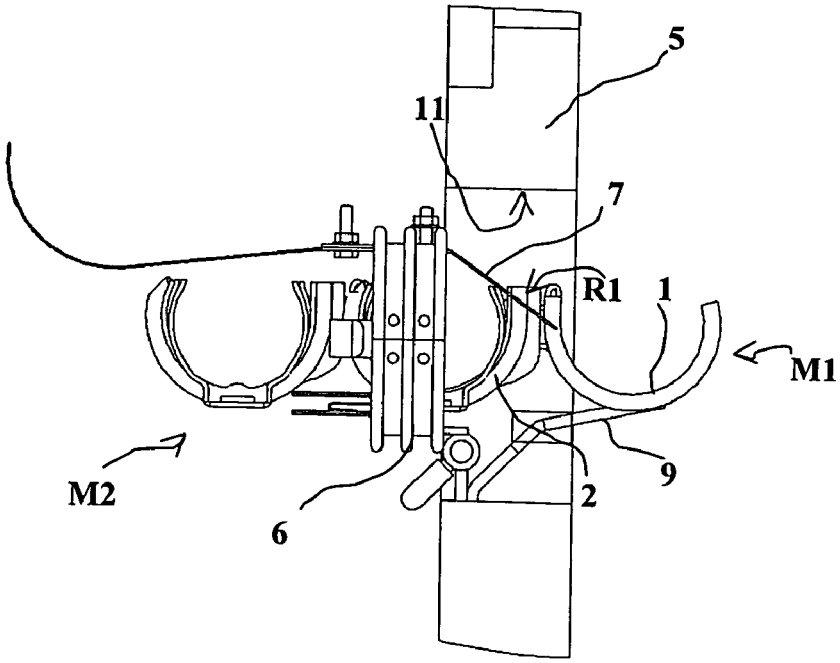

FIG. 3*b* shows the beginning of the deformation of the elastic tabs 7. These tabs pass the front edge R1 of the lateral stirrup 2 without the link M1 having pivoted. In fact, it is still resting on the support band 9.

Figure 3C:
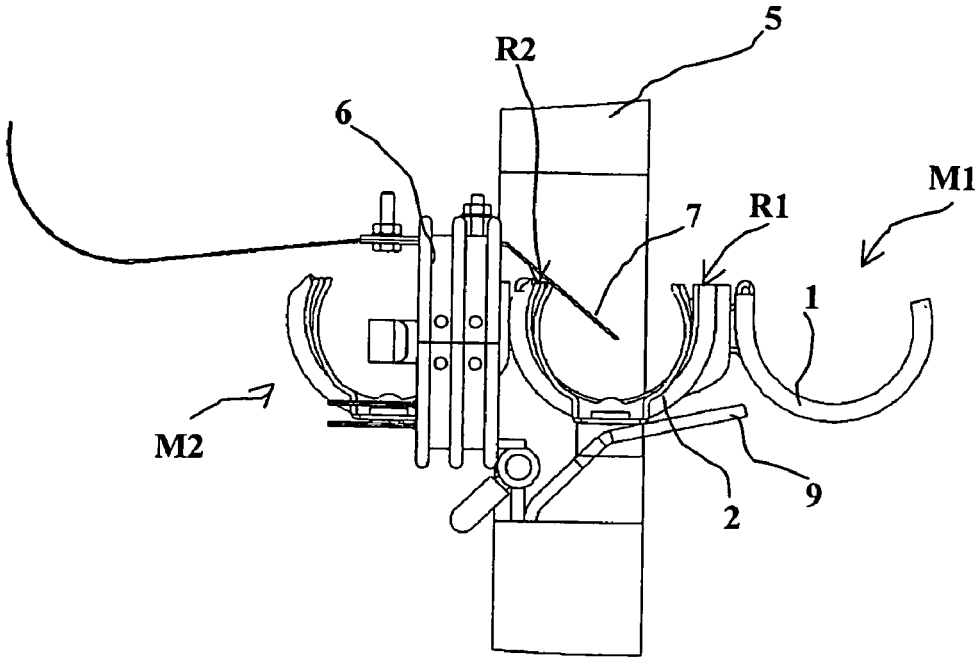
Figure 3D:
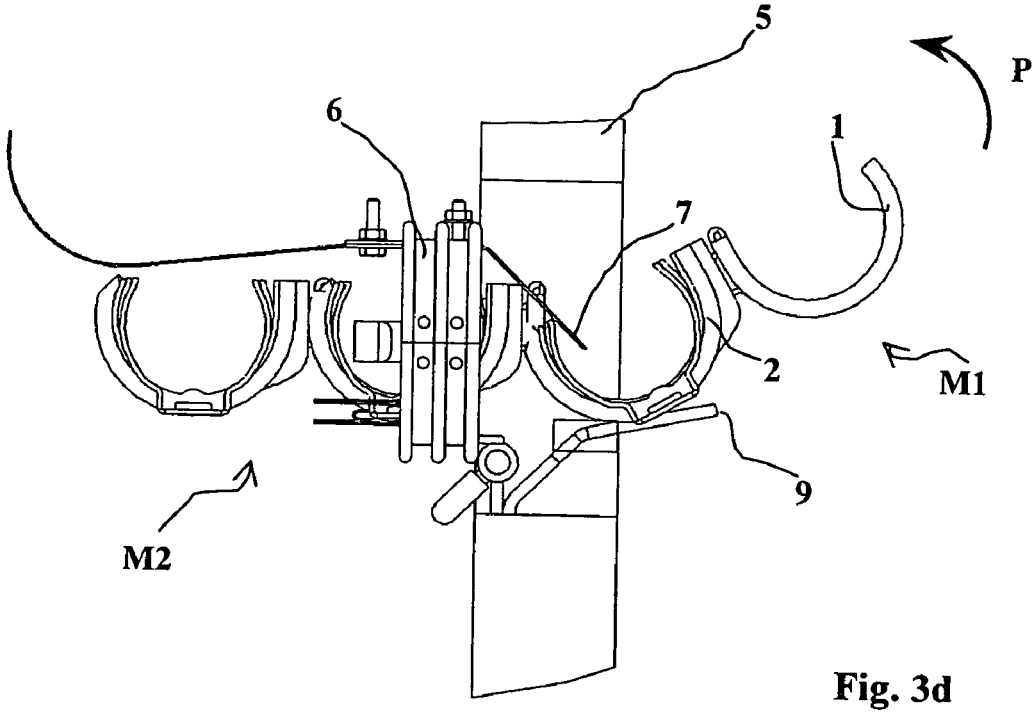

FIG. 3*c* shows the beginning of the deformation of the elastic tabs 7 when they come into contact with the rear edge R2 of the lateral stirrups 2 of the first link M1.

The tabs' 7 stiffness is chosen such that it provides support for the lateral stirrups 2. This results in a pivoting (arrow P) of the first link M1 with respect to the second link M2 (see FIG. 3*d*).

Figure 3E:
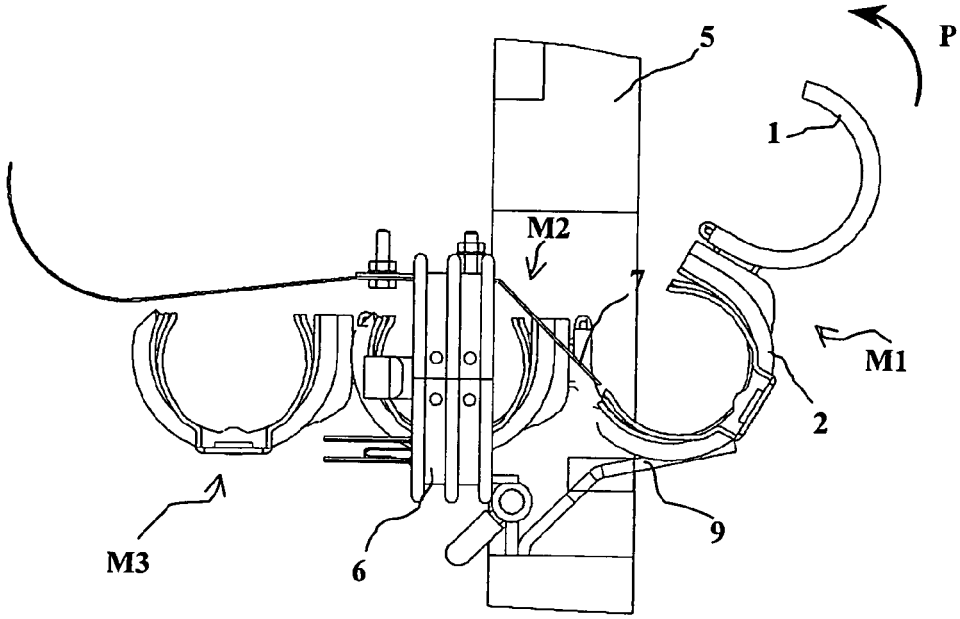

Beyond a certain pivoting angle, link M1 is disengaged from link M2 (FIG. 3*e*). The tabs 7 are then in contact with the front edges R1 of the lateral stirrups 2 of the second link M2.

Figure 3F:
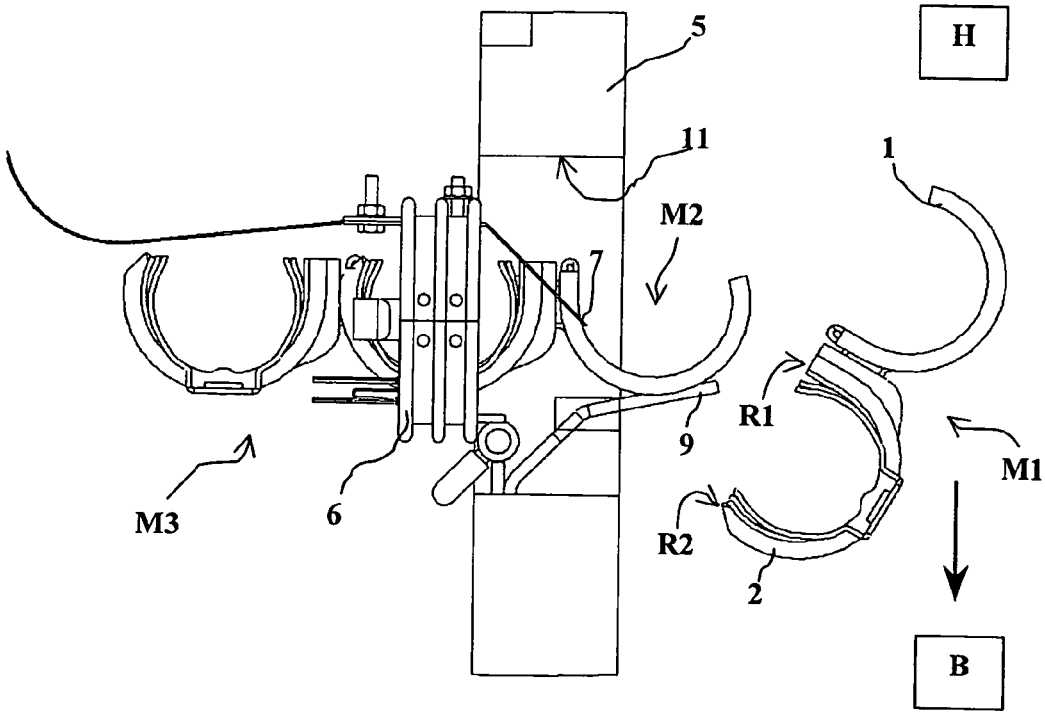

The device is now in the arrangement shown in FIG. 3*f* which is analogous to that in FIG. 3*b* and the first link falls to the ground through the effect of gravity.

The structure of the device according to the invention can be seen to be very simple. It requires no adjustment and reliably ensures the pivoting necessary for the separation of the links. Indeed, during operation, each link is held at three points:

- the rigid support band 9 which positions the link in a substantially horizontal direction (or tilted slightly upwards),
- the two elastic tabs 7 which are applied onto the lateral stirrups 2 of the link for as long as it presses on the band 9.

This three-point hold results in a stable pivoting of one link with respect to the following link and the release of the link from a relative angular position which is reproducible, thereby ensuring the reliability of the separation.

It is possible for the elastic tabs to be replaced by other means enabling the passage of the links and ensuring the required pivoting.

Figure 4:
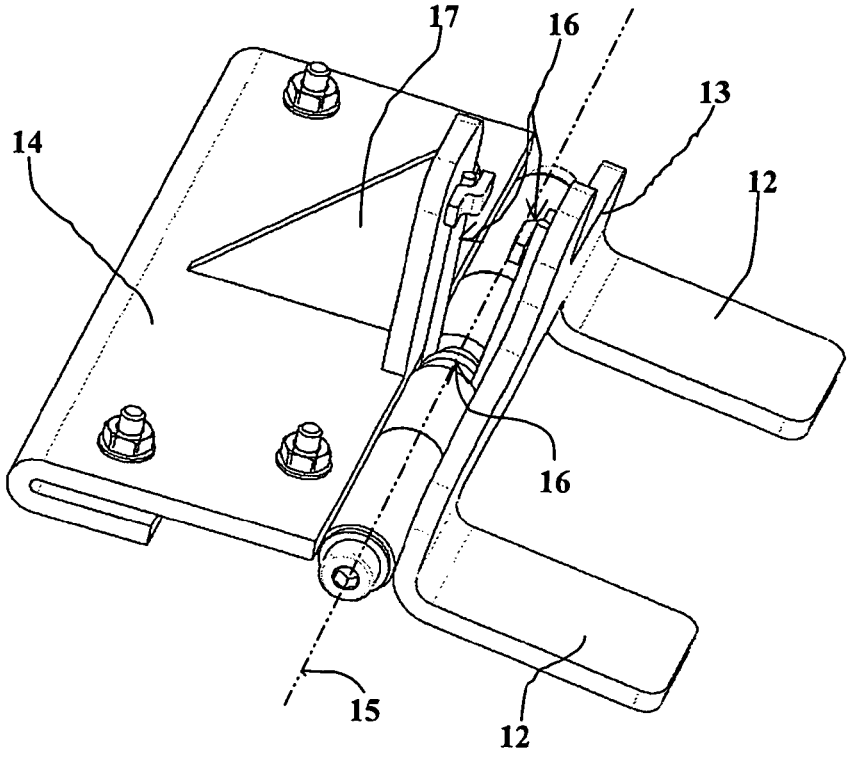
FIG. 4 shows a second embodiment of a device according to the invention.
Figure 5:
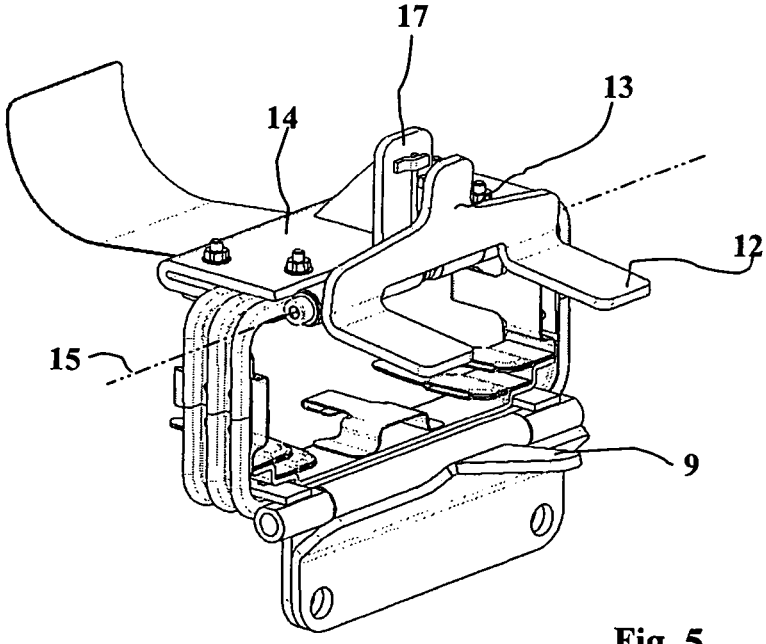
FIG. 5 shows this second embodiment installed on the frame.

FIGS. 4 and 5 show an embodiment of the device comprising two tabs 12 which are rigid and integral with a clack valve 13. The valve 13 is hinged with respect to a plate 14 which is fixed to the frame 6.

The valve 13 carrying the tabs 12 is able to pivot with respect to the plate 14 around a pin 15.

A torsion spring 16 is positioned around the pin 15 and presses firstly on the valve 13 and secondly on a bracket 17 integral with the plate 14.

The spring is mounted such that when the tabs 12 are pushed by the links exiting through the frame 6, the spring 16 is stressed and tends to bring the valve and the tabs back into their starting position.

The torsion spring 16 thereby enables the link body to be made to pivot. The operation of this embodiment is identical to that of the previous one. It is thus unnecessary to describe it in further detail.

This embodiment has the advantage of being more robust and less likely to wear.

What is claimed is:

1. A device to separate a first link and a second link of an ammunition belt exiting a weapon via an exit after firing, wherein the first link is detachably mounted to the second link, so as to pivot angularly with respect to the second link, the device comprising at least one tab and a support band wherein the at least one tab is attached to the weapon above the exit, and the support band is attached to the weapon below the exit, wherein the support band is configured to provide support for the exiting first link, and the at least one tab is configured to be pushed by the exiting first link against the action of a spring and which is configured to cooperate with a rear edge of the first link to make the first link pivot with respect to the second link thus separating the first link from the second link.

2. A device according to claim 1, wherein the at least one tab is a rigid tab operably linked to a torsion spring.

3. A device according to claim 1, comprising two tabs that are positioned on first side and a second side of the support band, respectively.

4. A device to separate a first link and a second link of an ammunition belt exiting a weapon via an exit after firing, wherein the first link is detachably mounted to the second link, so as to pivot angularly with respect to the second link, the device comprising at least one elastic tab and a support band wherein the at least one elastic tab is attached to the weapon above the exit, and the support band is attached to the weapon below the exit, wherein the support band is configured to provide support for the exiting first link, and the at least one elastic tab is configured to be deformed by the exiting first link, and which is further configured to cooperate with a rear edge of the first link to make it pivot with respect to the second link, thus separating the first link from the second link.

5. The device of claim 4, comprising two elastic tabs that are positioned on a first side and a second side of the support band, respectively.

* * * * *